United States Patent [19]

Newman et al.

[11] Patent Number: 4,813,897

[45] Date of Patent: Mar. 21, 1989

[54] COMBINED TRIM, TILT AND LIFT APPARATUS FOR A MARINE PROPULSION DEVICE

[75] Inventors: Neil A. Newman, Omro; John M. Griffiths; Wayne T. Beck, both of Fond du Lac, Wis.

[73] Assignee: Brunswick Corporation, Skokie, Ill.

[21] Appl. No.: 181,685

[22] Filed: Apr. 14, 1988

[51] Int. Cl.[4] ..... B63H 21/26

[52] U.S. Cl. ..... 440/61; 440/53; 248/641

[58] Field of Search ..... 440/61, 53, 62, 63, 440/65, 900; 248/640, 641

[56] References Cited

U.S. PATENT DOCUMENTS

| | | | |
|---|---|---|---|
| 2,782,744 | 2/1957 | Staley | 248/641 |
| 3,990,660 | 11/1976 | Dipoz | 248/641 |
| 4,013,249 | 3/1977 | Meyer et al. | 248/641 |
| 4,666,410 | 5/1987 | Anselm | 440/53 |
| 4,673,358 | 6/1987 | Iwai et al. | 440/61 |
| 4,682,961 | 7/1987 | Nakahama | 440/61 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A transom extension assembly for mounting an outboard motor in a spaced relation to the boat transom includes a quadrilateral linkage assembly in which each of the functions to trim, tilt and lift the motor with respect to the transom is provided independently. Each function is provided by a separate hydraulic cylinder means, but operating fluid pressure is supplied by a single fluid pressure source which may be mounted directly on the transom extension linkage.

13 Claims, 3 Drawing Sheets

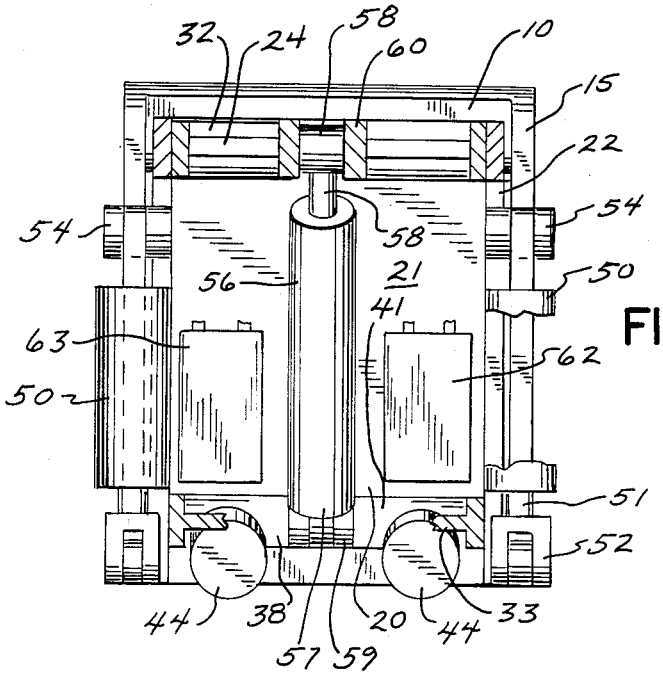
FIG. 3
FIG. 4
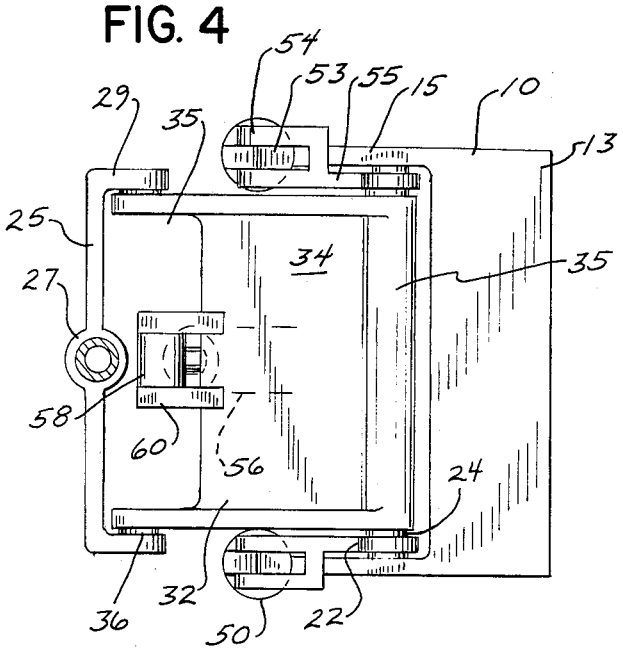
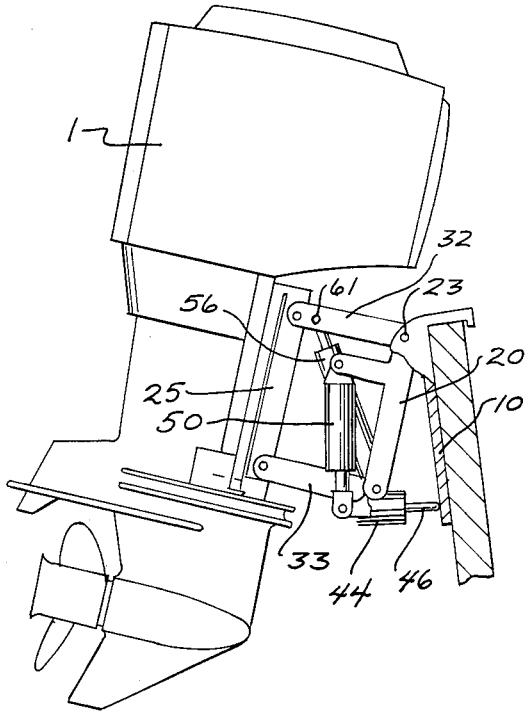
FIG. 5

FIG. 6
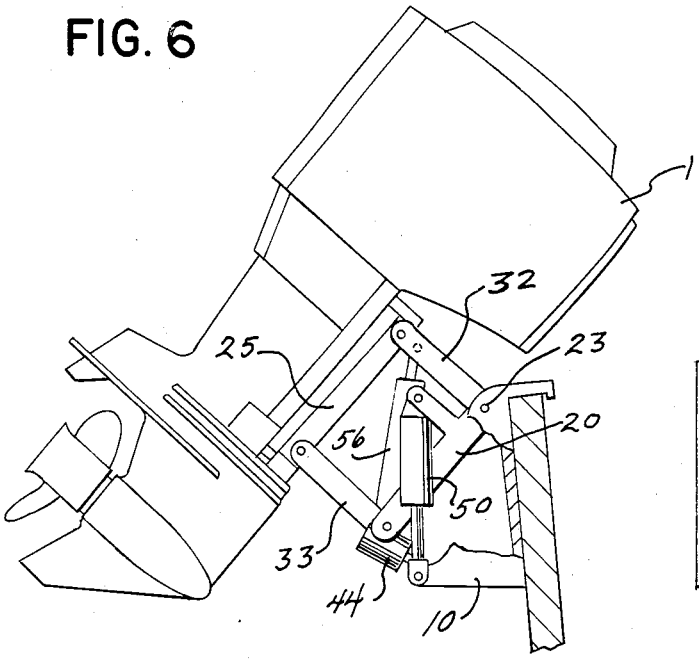
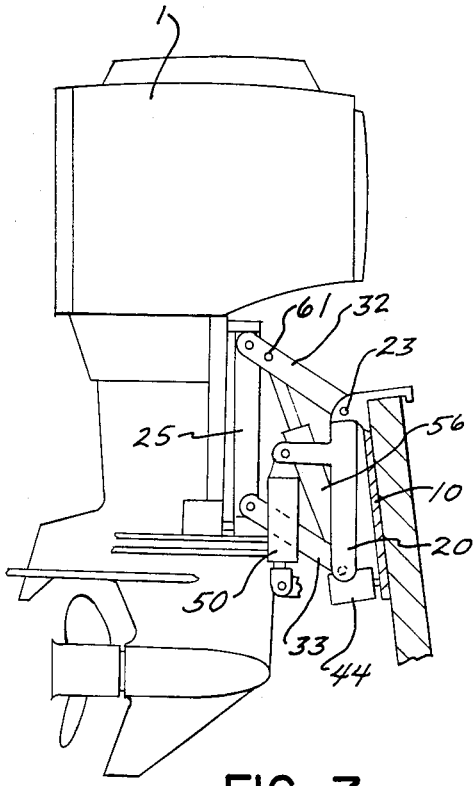
FIG. 7
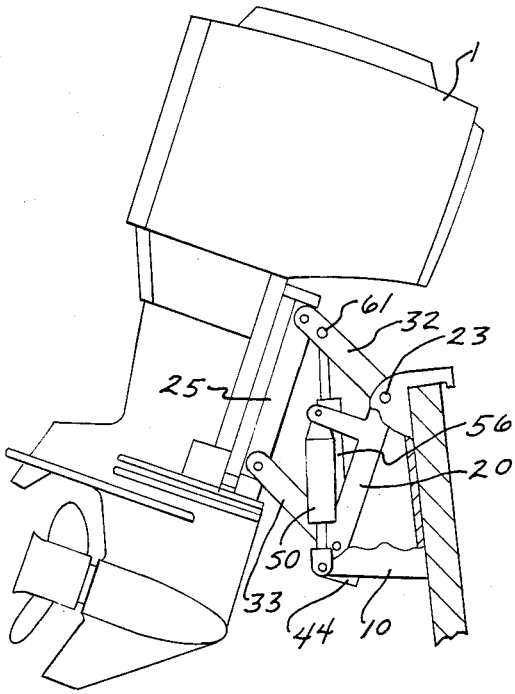
FIG. 8

COMBINED TRIM, TILT AND LIFT APPARATUS FOR A MARINE PROPULSION DEVICE

BACKGROUND OF THE INVENTION

The present invention relates to an apparatus for controlling the position of a marine propulsion device and, more particularly, to an apparatus for providing separate trim, tilt and lift movements for a transom extension mounting assembly carrying an outboard motor.

Marine propulsion devices, such as outboard motors and stern drives, are supported from the boat transom by a drive mounting assembly. Various types of drive mounting assemblies are known, as for example a transom bracket for mounting an outboard motor directly on a boat transom or a gimbal ring assembly for similarly mounting a stern drive unit directly to the transom. Typically a drive unit mounted directly on a transom may be trimmed by pivoting it about a generally horizontal axis to position the propeller and optimize thrust with respect to the plane of the boat. However, the vertical position of the drive unit cannot typically be changed beyond the somewhat limited amount which results from the trimming operation. Therefore, the drive unit is typically mounted in a compromise position at a fixed height which will provide the best performance. Another type of drive mounting assembly is one which is capable of selectively supporting an outboard motor in either a raised or a lowered position aft of the boat transom. Many of these transom extension types of mounting assemblies are of the general type which include a pivotally connected quadrilateral linkage. Recently, transom extension mounting assemblies have become increasingly popular on high performance boats powered by outboard motors, including bass boats, where a lower position of the motor improves initial boat acceleration, and a higher position enhances top speed by reducing gear case drag. Additionally, a higher motor position reduces draft, thereby enhancing shallow water operation. It is further known that relocating the motor aft of the transom improves the handling characteristics of most boats at high speeds. These devices also allow the boat to have a higher transom for improved safety in following wave conditions and they allow boat builders to manufacture a common hull and transom design for both outboard and stern drive applications.

Examples of transom extension mounting assemblies for outboard motors which support the motor spaced from the boat transom are disclosed in the following U.S. Pat. Nos. 2,782,744; 3,990,660; 4,013,249; 4,168,818; 4,673,358; and 4,682,961. The first four of the foregoing patents disclose apparatus which is utilized to raise the motor vertically and the latter two patents describe apparatus which is utilized to trim the propeller and tilt the motor up and out of the water about a generally horizontal axis.

U.S. Pat. No. 4,490,120 shows a hydraulic system for trimming and tilting an outboard motor in which a single electric motor-driven pump powers a pair of hydraulic trim cylinders and a single hydraulic tilt cylinder. U.S. Pat. No. 4,050,359 describes a system in which a pair of hydraulic cylinders provides combined trim and tilt functions, the latter to pivot the outboard motor to its highest position as to remove it from the water or trailering.

U.S. patent application Ser. No. 092,168, filed Sept. 2, 1987; Ser. No. 100,216, filed Sept. 23, 1987; and Ser. No. 103,508, filed Oct. 1, 1987, all of which are assigned to the assignee of this application, disclose outboard motor transom extension mounting assemblies which utilize a quadrilateral linkage arrangement to raise and lower the motor with respect to the transom. The quadrilateral linkage comprises four pivotally connected links forming a collapsible linkage the movement of which effects vertical movement of the motor. In particular, pending application Ser. No. 103,508 discloses a quadrilateral transom mounting bracket with opposite arms of unequal length, the effect of which is to provide limited trimming movement of the motor simultaneously with the lift movement.

In summary, the prior art discloses apparatus for providing a trim or trim/tilt function for outboard motors which are attached directly to the transom or which are spaced therefrom on transom extension mounting assemblies. Further, transom extension mounting assemblies for outboard motors are known which provide solely a lift function or solely a trim/tilt function. Finally, in the commonly owned pending application Ser. No. 103,508 identified above, a transom extension assembly providing primarily a lift function also provides a simultaneous trim function.

However, it would be desirable to have a transom extension mounting assembly for an outboard motor in which trim, tilt and lift functions could be performed and controlled independently. Further, such an apparatus utilizing a single power source would be most desirable.

SUMMARY OF THE INVENTION

The present invention provides a position control apparatus particularly adapted for use with an outboard motor mounted on a transom extension assembly which combines the trim, tilt and lift functions in one apparatus, but with a construction by which each function may be provided separately and independently of the other. Separate power means control and operate each function, but all may be operated from a single power source.

In its preferred embodiment, the apparatus includes a mounting plate attached to the boat transom, a collapsible quadrilateral linkage assembly which includes a forward leg pivotally connected at one end to the mounting plate to provide for rotation of the linkage assembly about a generally horizontal axis, and aft leg to which the outboard motor is attached, and upper and lower legs pivotally interconnecting the upper and lower ends, respectively, of the forward and aft legs. A combined power rotation means, providing both rotational trimming and tilting movement of the linkage about the horizontal axis, may be utilized to operatively interconnect the mounting plate and the forward leg of the linkage. Preferably, however, separate power trim means interconnect the forward leg and the mounting plate to provide a limited amount of trim rotation of the linkage assembly and attached drive unit about the generally horizontal axis. Separate power tilt means interconnects the lower end of the mounting plate and the forward leg of the linkage assembly to provide extended rotation of the linkage assembly and attached drive unit about the horizontal axis and beyond the limited amount provided by the power trim means. Power lift means interconnects a pair of the legs of the linkage to provide a controlled collapse of the linkage and resulting vertical movement of the aft leg and attached drive unit with respect to the forward leg. The aft leg preferably comprises a swivel bracket to which is attached an outboard motor for steering movement about a generally vertical axis.

Each of the power trim, power tilt and power lift means preferably comprises a separate fluid cylinder means. In a preferred form, the power trim means comprises a pair of hydraulic cylinders which are attached at their cylinder ends to the forward leg of the linkage and have their rod ends in operative engagement with the mounting plate. The power tilt means also comprises a pair of hydraulic cylinder having their rod ends pivotally attached to the mounting plate and their cylinder ends pivotally attached to the forward leg of the quadrilateral linkage. Similarly, the power lift means comprises a third hydraulic cylinder disposed with its cylinder and rod ends pivotally attached to separate legs of the quadrilateral linkage. Preferably, the power lift cylinder has its cylinder end attached to the lower end of the forward leg and its rod end attached to the aft end of the upper leg.

A common fluid pressure supply means is provided for the separate trim, tilt and lift hydraulic cylinders. The fluid pressure supply means preferably comprises an electric motor-driven hydraulic pump, and control means to operate the pump for selectively supplying pressurized hydraulic fluid to any one of the trim, tilt, or lift cylinders. In its preferred embodiment, the motor/-pump and reservoir are attached to the forward leg of the linkage assembly, along with the pair of trim cylinders and the single lift cylinder.

BRIEF DESCRIPTION OF THE DRAWINGS

FIG. 3 is a vertical section through the apparatus taken on line 3—3 of FIG. 2.

FIG. 4 is a plan view of the apparatus, partly in section, taken on line 4—4 of FIG. 2.

FIGS. 5 through 8 are schematic representations of the apparatus showing the variations in control of the position of an outboard motor which the apparatus provides.

DETAILED DESCRIPTION OF THE PREFERRED EMBODIMENT

Figure 1:
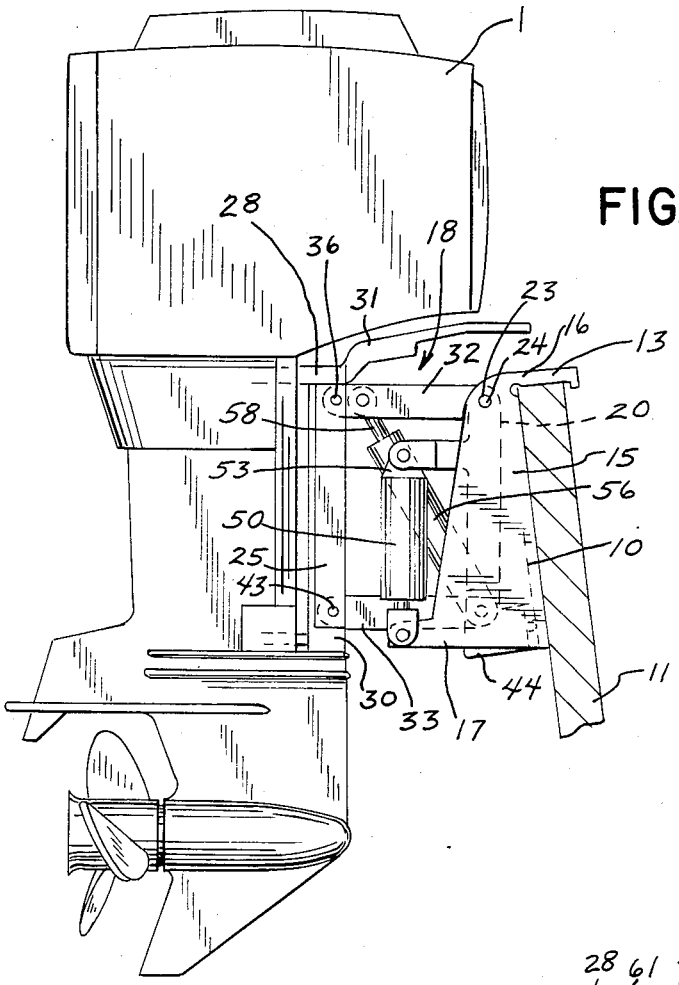
FIG. 1 is a side elevation of the apparatus of the present invention showing an outboard motor attached to a transom extension assembly.

The apparatus of the present invention is especially adapted to mount an outboard motor to the transom of a boat such that various movements of the motor with respect to the transom required for convenient or efficient operation may be separately effected. The apparatus includes a mounting plate 10 adapted to be attached directly to the transom 11 of a boat. The mounting plate 10 includes a flat central body 12 adapted to lie flush against the outside surface of the transom 11. The mounting plate may be held in place by an integral upper flange 13 which extends over the upper edge of the transom. The upper flange 13 may be constructed in the manner of a conventional outboard motor transom bracket and, therefore, include the conventional clamping members (not shown) bearing against the inside surface of the transom 11. In lieu of the demountable clamping members, the mounting plate 10 may be more permanently attached to the transom by bolted connections 14 extending through appropriately aligned holes in the plate and the transom.

The mounting plate 10 includes a pair of lateral side flanges 15 extending aft of the transom and the body 12 and generally perpendicular thereto. Preferably, the side flanges 15 are tapered from a narrow upper end 16 to a wider lower end 17 projecting a substantial distance aft of the mounting plate body 12.

A collapsible 4-leg linkage assembly 18 is adapted to be pivotally connected at its forward end to the mounting plate 10 and to carry the outboard motor 1 on its aft end. The linkage assembly 18 includes a forward leg 20 including a wide central section 21 and integral lateral edge portions 22. The forward leg 20 is adapted to fit between the side flanges 15 of the mounting plate 10 and is pivotally connected at its upper end to the narrow upper ends 16 of the side flanges. The pivotal connection 23 between the forward leg 20 and the mounting plate 10 may be effected by a single pivot pin 24 extending the full width of the mounting plate 10. The pivotal connection 23 constitutes the primary horizontal axis for rotation of the linkage assembly 18 with respect to the mounting plate 10.

The linkage assembly 18 further includes an aft leg 25 disposed parallel to and spaced rearwardly of the forward leg 20. The aft leg includes a vertically disposed tubular center section which comprises a conventional swivel tube 27 for mounting an outboard motor. As is well known in the art, the motor is pivotally attached to the swivel tube 27 by upper and lower engine mounts 28 and 30, respectively, for steering movement in a horizontal plane. Thus, the upper engine mount 28 may include an integral steering arm 31 which extends forwardly toward the boat for connection to a conventional steering mechanism.

The aft leg 25 is pivotally connected to the forward leg 20 by upper and lower legs 32 and 33, respectively. The upper leg 32 includes a substantially flat body portion 34 and integral cylindrical forward and aft ends 35 having horizontal disposed open bores extending therethrough. The forward cylindrical end 35 of the upper leg 32 is adapted to fit between the edge portions 22 of the forward leg 20 and to be pivotally mounted therewith to the mounting plate 10 on the pivot pin 24. The aft end of the upper leg 32 is adapted to fit between the upper ends of the lateral flanges 29 of the aft leg 25 for pivotal connection thereto by a pivot pin 36 extending through the cylindrical aft end 35 and appropriately aligned holes in the lateral flanges 29.

The lower leg 33 is of a construction somewhat like the upper leg. Thus the lower leg also includes a substantially flat body portion 37 and integral forward and aft cylindrical ends 38 provided with horizontal through bores. The forward cylindrical end 38 of the lower leg 33 may be split into two axially aligned ears 41 to define therebetween an open notch for a purpose to be described hereinafter. As with the upper leg, the forward end of the lower leg 33 is adapted to fit between the edge portions 22 near the lower end of the forward leg 20 and to be pivotally connected thereto by a pivot pin 42. Pivot pin 42 may extend the full width of the forward leg 20. The aft cylindrical end 38 of the lower leg 33 is adapted to fit between the lower ends of the lateral flanges 29 of the aft leg 25 and to be pivotally connected thereto with a pivot pin 43.

As shown, the body or central portions of each of the legs 20, 25, 32, and 33 are of essentially solid construction to provide stability and rigidity to the linkage assembly 18. The legs may, however, comprise a more open construction provided the requisite stability and strength are maintained. Such open construction may also be convenient or necessary to accommodate other components of the apparatus.

Figure 2:
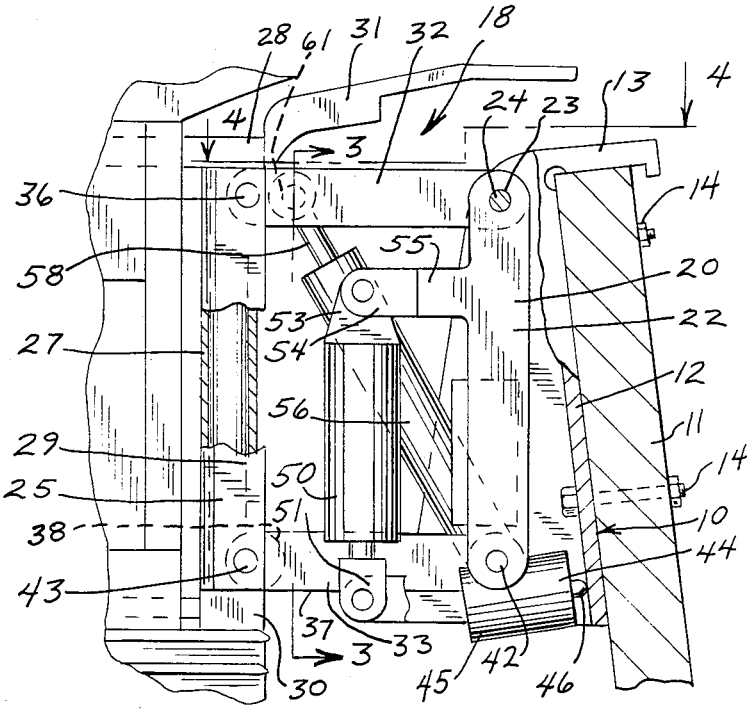
FIG. 2 is an enlarged view of the assembly shown in FIG. 1 with certain parts broken away for clarity.

As shown in FIGS. 1 and 2, the linkage assembly is shown in its fully opened position wherein the outboard motor is disposed in its lowermost position with respect to the boat. The aft leg 25 and the outboard motor mounted thereon may be moved vertically upward relative to the forward leg and mounting plate 10 by effecting a closing or collapse of the linkage, as is known in the art. In addition, the entire linkage assembly 18 with the outboard motor mounted thereon may be tilted relative to the mounting plate 10 and transom 11 by rotating the assembly about the primary pivotal connection 23 provided by the pivot pin 24. The lifting and tilting of the motor with respect to the boat transom 11 are each effected by separate fluid cylinder means and the tilting function is further separated into separate initial trimming rotation and a more extensive tilting rotation, each in turn provided by individual fluid cylinder means.

The trimming function is provided by a pair of trim cylinders 44 which are attached to the lower end of the forward leg 20. The cylinder housings 45 may be conveniently formed or cast as an integral part of the central section 21 of the forward leg 20. Because the typical trim function generally does not require relative rotational movement of the motor with respect to the transom in excess of about 10° to 12°, the trim cylinders 44 require only a relatively short stroke and, therefore, the overall length of the cylinders 44 is also relatively short. The cylinders 44 are disposed with their cylinder rods 46 extending forwardly, such that the ends thereof bear against the body 12 of the mounting plate 10 near the lower edge thereof.

The trim cylinders 44 are of a typical double-acting type and fluid pressure for their operation is provided an electric motor operated reversible hydraulic pump. Extension of the cylinder rods 46 will cause the entire linkage assembly 18 to rotate about the horizontal pivot pin 24 and cause the outboard motor attached thereto to be trimmed out, as shown in FIG. 5. Retraction of the cylinder rods by reversing the operation of the hydraulic pump will, of course, result in return rotation of the linkage assembly 18 and a trimming in of the attached motor to the FIG. 1 position.

A pair of tilt cylinders 50 provides an operative connection between the forward leg 20 and the mounting plate 10 for rotation of the linkage assembly about the pivot pin 24 beyond the limited trim rotation provided by the trim cylinders 44. Each tilt cylinder 50 includes a rod end 51 pivotally attached by a clevis 52 to the lower end 17 of the mounting plate side flange 15. The cylinder end 53 of the cylinder 50 has its free upper end pivotally attached to a second clevis 54 on the end of a clevis arm 55 forming a integral extension of the edge portion 22 of the forward leg 20. Each of the second clevises 54 is offset laterally and disposed in vertical alignment with the first clevis 52 to provide the required clearance for the tilt cylinder over its full range of extension. Also, as may best be seen in FIG. 2, the substantial rearward extension provided by the clevis arms 55 provides an adequate moment arm about the pivotal connection 23 for the tilting rotation of the linkage assembly 18.

During operation of the trim cylinders 44, the tilt cylinders 50 must be simultaneously extended by appropriate control of the fluid pressure, as is described in detail in U.S. Pat. No. 4,490,120. Since trimming movement is typically undertaken during operation of the outboard motor, simultaneous operation of the tilt cylinders during trimming provides additional lifting power to overcome the forward thrust of the motor. Beyond the range of operation of the trim cylinders, the substantially longer stroke of the tilt cylinders 50 allows the linkage assembly 18 and attached motor to be tilted about the pivotal connection 23 to a high position required, for example, for shallow water operation or trailering. The tilt cylinders may also be provided with a shock-responsive piston assembly which allows the motor to tilt up should it strike an underwater object and automatically return to its operating position, as is well known in the art and also described in the above identified U.S. patent.

To provide a separate vertical lift of the outboard motor relative to the boat transom, a lift cylinder 56 is pivotally mounted to the interior of the linkage assembly 18. The lift cylinder 56 includes a cylinder end 57 pivotally attached to the lower end of the forward leg 20. Preferably, the pivotal connection is made via a pair of ears 59 centrally located on the lower end of the forward leg and disposed on the axis of the pivot pin 42. The notch between the spaced cylindrical ends 38 on the forward end of the lower leg accommodate the ears 59 and the pivotally connected cylinder end 57 of the lift cylinder 56. The rod end 58 of the lift cylinder 56 is pivotally attached to the upper leg 32 adjacent its aft end. In particular, a integral clevis 60 on the underside of the upper leg 32 accommodates a separate pinned connection 61 to the rod end 58. Extension of the rod end of the lift cylinder 56 by applying fluid pressure to the cylinder end of the piston will result in a collapse of the linkage 18 with the oppositely disposed legs moving toward one another and movement of the aft leg 25 carrying the outboard motor vertically upward. Because each oppositely disposed pair of legs 20, 25 and 32, 33 is of equal length, the movement of the aft leg in the specific linkage shown will be directly vertical with no simultaneous tilting. The lift cylinder 56 may be mounted to a linkage assembly between any two legs thereof in which its extension would result in the collapse of the linkage described above. Thus, the cylinder end 57 of the lift cylinder 56 could be pivotally attached to the forward leg 20 above the pivot pin 42 or to the lower leg 33 rearwardly of the pivot pin 42. Similarly, the pivotal connection of the rod end 58 could be common with the pivot pin 36 or by means of a separate pivotal connection to the aft leg 25 below the pivot pin 36.

The unique arrangement and attachment of the separate trim, tilt and lift cylinders allows independent operation of each and an extremely wide range in the positioning and orientation of the motor with respect to the transom of the boat. Both the trimming and tilting functions are effected by extension of the respective trim and tilt cylinders 44 and 50, both of which operatively interconnect the mounting plate 10 and the forward leg 20. Such trim/tilt movement results in rotation of the forward leg 20 about the pivotal connection 23 to the mounting plate and such rotation carries with it the rest of the linkage assembly 18 without regard to or without affecting the position of the lift cylinder 56. Thus, any amount of lift or no lift at all may be provided at any trim or any tilt position. Similarly, extension of the lift cylinder 56 results in relative movement of all of the legs of the linkage assembly with respect to the mounting plate and the transom, except the forward leg 20. Thus, any amount of lift may be applied to the system at any position of the trim cylinders or the tilt cylinders.

A few representations of the wide range of position control provided by the trim, tilt and lift apparatus of the present invention are shown in FIGS. 5 through 8. In FIG. 5, the linkage assembly 18 and attached outboard motor are shown in the fully trimmed out position with the trim cylinders 44 fully extended and the assembly rotated upwardly about the pivotal connection 23. The tilt and lift cylinders 50 and 56, respectively, are fully retracted and, as a result, no additional tilting or lift is provided. In FIG. 6, the tilt cylinders 50 are fully extended to provide maximum upward tilting rotation of the assembly and motor about the pivotal connection 23. The fully extended trim cylinders 44 are carried away on engagement with the mounting plate pin and the lift cylinder 56 is fully retracted. In FIG. 7, the motor is disposed in the fully trimmed in position with the trim and tilt cylinders fully retracted, but with the motor lifted vertically to its highest position by full extension of the lift cylinder 56. In FIG. 8, the motor is in a position intermediate that shown in FIGS. 6 and 7, which position is effected by partial extensions of the tilt and lift cylinders 50 and 56, respectively.

The fluid pressure required to operate each of the trim, tilt and lift cylinders may be conveniently supplied from a common source. Further, the source of the fluid pressure may be mounted to the forward leg 20, thereby minimizing the lengths of the various hydraulic connections and eliminating completely the need for connection to a remote source of fluid pressure, such as from within the boat. Referring to the drawing, a unitary fluid pressure source 62 is mounted directly to the central section 21 of the forward leg between one of the edge portions 22 and the lift cylinder 56. The fluid pressure source 62 may be completely self-contained, including an electric motor, hydraulic pump and reservoir of hydraulic fluid. The only external connection required is to a source of electric power to operate the motor within the self-contained fluid pressure source 62. A suitable control valve assembly 63 may be provided to separately control the trim, tilt and lift functions. For example, the trim, and tilt functions may be appropriately controlled with the hydraulic controls described in the above identified U.S. Pat. No. 4,490,120. In addition, the hydraulic control for the lift cylinder may also comprise a conventional spool valve to control the flow of hydraulic fluid from the pump in the fluid pressure source 62.

The arrangement of the separate trim, tilt and lift cylinders 44, 50 and 56, respectively, enables extremely varied and precise control of the position of the outboard motor in a system which is relatively simple and compact. Although it is preferable to provide the trim and tilt functions separately, as hereinbefore described, it is possible to combine the trim and tilt functions in a single set of hydraulic cylinders, as described in U.S. Pat. No. 4,050,359. In this alternate embodiment, the tilt cylinders 50 would be utilized to provide the combined function and the trim cylinders 44 would be eliminated.

Various modes of carrying out the invention are contemplated as being within the scope of the following claims particularly pointing out and distinctly claiming the subject matter which is regarded as the invention.

I claim:

1. A combined trim, tilt and lift apparatus for a transom-mounted marine propulsion device comprising:

a mounting plate attached to the boat transom;

a collapsible four-leg linkage assembly including a forward leg pivotally connected at its upper end to the mounting plate for rotation of the linkage assembly about a generally horizontal axis, an aft leg adapted to support the propulsion device, an upper leg pivotally connected at its ends to the upper ends of the forward and aft legs, and a lower leg pivotally connected at its ends to the lower ends of the forward and aft legs;

power rotation means operatively interconnecting the linkage assembly and the mounting plate for providing trimming and tilting rotation of the linkage assembly about the generally horizontal axis; and, power lift means operatively interconnecting a pair of the legs of the linkage for effecting controlled collapse of the linkage and generally vertical movement of the aft leg with respect to the forward leg.

2. The apparatus of claim 1 wherein the power rotation means comprises power trim means operatively interconnecting the forward leg and the mounting plate for providing limited trimming rotation of the linkage assembly about the generally horizontal axis, and power tilt means operatively interconnecting the forward leg and the mounting plate for providing tilting rotation of the linkage assembly beyond said limited trimming rotation.

3. A combined trim, tilt and lift apparatus for a transom-mounted marine propulsion device comprising:

a mounting plate attached to the boat transom;

a collapsible four-leg linkage assembly including a forward leg pivotally connected at its upper end to the mounting plate for rotation of the linkage assembly about a generally horizontal axis, an aft leg adapted to support the propulsion device, an upper leg pivotally connected at its ends to the upper ends of the forward and aft legs, and a lower leg pivotally connected at its ends to the lower ends of the forward and aft legs;

power trim means operatively interconnecting the forward leg and the mounting plate for providing a limited amount of rotation of the linkage assembly about the generally horizontal axis;

power tilt means operatively interconnecting the lower end of the mounting plate and the forward leg of the linkage assembly for providing rotation of the linkage assembly about the horizontal axis beyond said limited amount; and power lift means operatively interconnecting a pair of the legs of the linkage for effecting controlled collapse of the linkage and generally vertical movement of the aft leg with respect to the forward leg.

4. The apparatus of claim 3 wherein the propulsion device comprises an outboard motor and the aft leg of the linkage comprises a swivel bracket mounting the motor for steering movement about a generally vertical axis.

5. The apparatus of claim 3 wherein the power trim means comprises first fluid cylinder means having a cylinder end and a rod end, said first fluid cylinder means being operatively disposed between the lower end of the forward leg of the linkage and the mounting plate below said horizontal axis.

6. The apparatus of claim 5 wherein the first fluid cylinder means comprises a pair of hydraulic trim cylinders attached at their cylinder ends to the forward leg and disposed with their rod ends in engagement with the mounting plate.

7. The apparatus of claim 5 wherein the power tilt means comprises second fluid cylinder means having a cylinder end and a rod end pivotally interconnecting the mounting plate and the forward leg of the linkage assembly to provide a rotational moment to the linkage about said horizontal axis.

8. The apparatus of claim 7 wherein said second fluid cylinder means comprises a pair of tilt cylinders, each having its rod end pivotally attached to the lower end of the mounting plate and its cylinder end pivotally attached to the forward leg.

9. The apparatus of claim 7 wherein the power lift means comprises third fluid cylinder means having a cylinder end pivotally attached to one leg of the linkage and a rod end pivotally attached to another leg of the linkage.

10. The apparatus of claim 9 wherein said third fluid cylinder means comprises a hydraulic lift cylinder having its cylinder end attached to the lower end of the forward leg its rod end attached to and the aft end of the upper leg.

11. The apparatus of claim 9 comprising a common fluid pressure supply means for said first, second and third fluid cylinder means.

12. The apparatus of claim 11 wherein said fluid pressure supply means comprises:

an electric motor-driven hydraulic pump;

a reservoir of hydraulic fluid for said pump; and, control means for operating the pump to selectively supply pressurized hydraulic fluid to each of said fluid cylinder means.

13. The apparatus of claim 12 wherein the pump and reservoir are attached to the forward leg of the linkage assembly.

* * * * *